United States Patent [19]

Watson et al.

[11] 4,222,018

[45] Sep. 9, 1980

[54] MODE FILTERS

[75] Inventors: Barry K. Watson, Witham; Ian L. Powell, Brentwood, both of England

[73] Assignee: The Marconi Company Limited, Chelmsford, England

[21] Appl. No.: 922,684

[22] Filed: Jul. 7, 1978

[30] Foreign Application Priority Data

Jul. 7, 1977 [GB] United Kingdom ..... 28452/77

[51] Int. Cl.[2] ..... H01P 1/16; H01P 3/13; H01P 1/18

[52] U.S. Cl. ..... 333/251; 333/157; 333/242

[58] Field of Search ..... 333/204, 238, 248, 251, 333/242, 243, 157

[56] References Cited

U.S. PATENT DOCUMENTS

| | | | |
|---|---|---|---|
| 3,251,011 | 5/1966 | Unger | 333/251 |
| 3,351,877 | 11/1967 | Unger et al. | 333/251 |
| 3,787,787 | 1/1974 | Shimada et al. | 333/251 |

OTHER PUBLICATIONS

Marcuvitz–"Waveguide Handbook" (Radiation Laboratory Series), Boston Technical Publishers, Inc. 1964; pp. 69–80.

*Primary Examiner*—Marvin L. Nussbaum
*Attorney, Agent, or Firm*—Diller, Ramik & Wight

[57] ABSTRACT

The invention relates to mode filters for millimetric waves. The mode filter provided includes a circularly sectioned waveguide divided into a number of equal sectorial channels. Dielectric mode perturbing material is provided in all but one of the channels. This material extends in the direction of the H-field so as not to interfere with a wanted mode of a propagated signal but to perturb the current lines of an unwanted $TE_{On}$ mode so that an −unwanted $TE_{On}$ mode in the channel containing the dielectric material undergoes a $\pi$radian phase shift relative to the $TE_{On}$ mode in the remaining channel which remaining channel has a conductive sectorial ridge of the same cross section as the sectorial channels and extending in the direction of the H-field the ridge being of such a radius that differential phase shifts produced by the perturbation effect of the mode perturbing material of the wanted mode cut-off frequency are substantially reduced.

4 Claims, 1 Drawing Figure

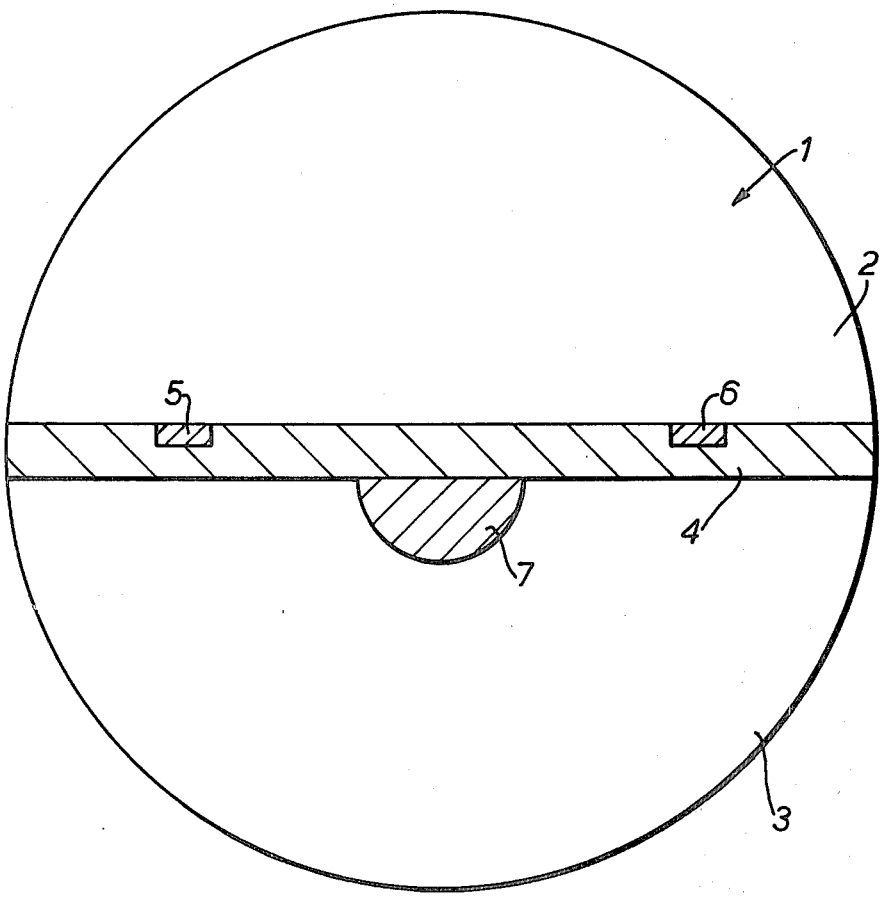
1
2
5
6
4
7
3

MODE FILTERS

This invention relates to mode filters and in particular to the type of mode filter described in our copending application Ser. No. 720,905.

According to our said copending application, a mode filter for millimetric waves includes a waveguide divided into at least two equal waveguide channels and mode perturbing means in said channels extending in the direction of the H-field so as not to substantially interfere with a wanted mode of a signal provided in operation, but to perturb the current lines of a predetermined unwanted mode of the signal such that said unwanted mode is substantially destroyed at an output port of the filter.

Whilst the performance of mode filters in accordance with the copending application have proved, in general, satisfactory it has been found that where, for example, the mode perturbing means is a dielectric material recessed into slots, the depth and width of the slot has a small second order effect upon the wanted mode. This effect, for some, but not all combinations of slot depth and width, manifests itself as differential phase shift of typically 10° or 15° between the waveguide channels in which the dielectric material is positioned compared to the channels in which there is no dielectric material.

By way of example, consider a circularly sectioned waveguide divided into semi-circularly sectioned waveguides by a conductive plate with slots mounted along the plate in one of the channels, the slots being filled with dielectric material and extending in the direction of the Hz field of an applied electro-magnetic wave and with the slots spaced so as to substantially affect only the current lines of an unwanted mode. Between certain values of slot depth and width, it has been found that the cut-off frequency of an applied $TE_{01}$ mode tends to marginally increase in that channel which is slotted compared to the unslotted channel whereas the cut-off frequency of an applied $TE_{02}$ mode tends to decrease in the channel which is slotted compared to the channel which is unslotted.

The present invention seeks to provide a mode filter in which the forementioned differential phase shift of a wanted mode is substantially reduced.

According to this invention a mode filter for millemetric wave includes a circularly sectioned waveguide divided into n equal sectorial channels, mode perturbing means in said channels extending in the direction of the H-field so as not to substantially interfere with a wanted mode of a signal, provided in operation, but to perturb the current lines of a predetermined unwanted mode, and a conductive sectorial ridge having the same cross-section as the sectorial channels which ridge also extends in the direction of the H-field and is positioned along the longitudinal axis of the circularly sectioned waveguide in at least one of the sectorial channels, said ridge being of such a radius that differential phase shifts produced by the perturbation effect of the mode perturbing means of the wanted mode cut-off frequency are substantially reduced.

Preferably, the mode perturbation means is a dielectric material provided in $(n-1)$ of the channels such that an unwanted $TE_{On}$ mode in said $(n-1)$ channel or channels undergoes a $\pi$ radian phase shift relative the $Te_{On}$ mode in the remaining channel, and the ridge is positioned in said remaining channel.

In some embodiments, where n is greater than 2 and the dielectric material has different lengths in the channels, then the ridge may, with advantage, be positioned in channels other than said remaining channel in dependence upon the differential phase shifts of the wanted mode in the various channels.

The invention will now be described, by way of example with reference to the accompanying drawings which show a cross section of a mode filter in accordance with this invention for the propagation of wanted $Te_{01}$ mode and the substantial elimination of a $TE_{02}$ mode.

The mode filter shown in the drawing has a circularly sectioned waveguide 1 divided into semi-circularly sectioned vaveguide channels 2, 3 by a conductive plate 4. Mounted along the plate 4 in the channel 2 extending in the direction of the Hz field are two longitudinally, parallel, spaced dielectric strip phase shifting members 5, 6 formed, for example, from the material known under the trade name of "Melinex". The strip members 5, 6 are recessed into slots in the plate 4 so as to be flush with the inside surface of the channel 2 and are spaced 0.6276R, where R is the radius of the circularly sectioned waveguide 1, from the longitudinal axis of the waveguide 1 so that substantially only the current lines of an unwanted $TE_{02}$ mode are affected thereby. As described thus far, the mode filter is substantially the same as that described in FIG. 1 of our copending application Ser. No. 720,905 and as stated above a small differential phase shift is, in some circumstances, in fact, introduced by the effect of the slots on the $TE_{01}{}^{\Delta}$ mode cut-off frequency. This differential phase shift is substantially reduced by providing conductive ridge 7 along the longitudinal axis of the waveguide 1 having the same cross-section (in the present example, semicircular) as the channel in which the ridge is mounted and which ridge is provided in the unslotted channel 3.

The ridge 7 has the effect of increasing the cut-off frequency of the $TE_{01}{}^{\Delta}$ mode in the channel 3 when the ridge 7 is inserted compared to the $TE_{01}{}^{\Delta}$ mode cut-off frequency prior to insertion of the ridge 7. The radius of the ridge is calculated to be such that the differential phase shift of the $TE_{01}$ mode cut-off frequency between the slotted 2 and unslotted 3 channels is substantially eliminated.

It is also found that the $TE_{02}{}^{\Delta}$ cut-off frequency for the channel 3 is increased when the ridge 7 is inserted and since, for cancellation of the $TE_{02}{}^{\Delta}$ mode, it is required that the equation $L(\beta_2-\beta_3)=180°$ be satisfied.

Where $\beta_2$=the phase change coefficient for the $TE_{02}$ mode in the channel 2 and $\beta_3$=the phase change coefficient for the $TE_{02}$ mode for the channel 3, it will be realised that because the differential phase shift of the cut-off frequency of the $TE_{02}{}^{\Delta}$ is now positive, the overall length of the filter is reduced.

Although described above for semi-circular waveguide channels, it is envisaged that the invention is applicable to a circularly sectioned waveguide divided into n sectors and in such further embodiments the ridge 7 may be provided in such channels as is necessary to reduce the differential phase shift of the wanted $TE_{01}$ mode in dependence upon the differential phase shifts of the wanted mode in the various channels.

We claim:

1. A mode filter for millimetric waves including a circularly sectioned waveguide divided into n equal sectorial channels, mode perturbing means in said channels extending in the direction of the H-field so as not to substantially interfere with a wanted mode of a signal, provided in operation, but to perturb the current lines of a predetermined unwanted mode, and a conductive sectorial ridge having the same cross-section as the sectorial channels which ridge also extends in the direction of the H-field and is positioned along the longitudinal axis of the circularly sectioned waveguide in at least one of the sectorial channels, said ridge being of such a radius that differential phase shifts produced by the perturbation effect of the mode perturbing means of the wanted mode cut-off frequency are substantially reduced.

2. A filter as claimed in claim 1 and wherein the mode perturbation means is a dielectric material provided in (n−1) of the channels such that an unwanted $TE_{On}^{\Delta}$ mode in said (n−1) channel or channels undergoes a $\pi$ radian phase shift relative the $TE_{On}^{\Delta}$ mode in the remaining channel, and the ridge is positioned in said remaining channel.

3. A filter as claimed in claim 1 wherein n is greater than 2 and the dielectric material has different lengths in the channels said ridge being positioned in channels other than said remaining channel in dependence upon the differential phase shifts of the wanted mode in the various channels.

4. A mode filter for millimetric waves comprising, in combination:

a length of circular waveguide adapted to be inserted into a waveguide in which a wanted TE mode and an unwanted TE mode are propogated;

wall means dividing said length of waveguide into at least two equal sectorial channels and including perturbation means in the form of a pair of parallel, longitudinal slots in the wall means defining one of said channels and dielectric means in said slots for preferentially affecting the current lines of said unwanted mode in said one channel, said slots being equally spaced on opposite sides of the longitudinal axis of the waveguide and having a width and depth which marginally increases the cut-off frequency of said wanted mode and tends to decrease the cut-off frequency of said unwanted mode; and a conductive sectorial ridge on said wall means within the remaining one of said channels, said ridge being concentrically positioned along the longitudinal axis of said length of waveguide and having a radius less than the radius of said length of waveguide such that the cut-off frequency of said wanted mode is increased while the cut-off frequency of the unwanted mode likewise is increased, and the filter having a length such that the unwanted mode suffers substantially a 180° differential phase shift between the two channels whereas the wanted mode suffers substantially no differential phase shift.

* * * * *